US012808563B2

(12) United States Patent
Zhang et al.

(10) Patent No.: US 12,808,563 B2
(45) Date of Patent: Nov. 24, 2026

(54) AIR SUPPLY DEVICE AND CONTROL METHOD THEREFOR

(71) Applicants: FOSHAN SHUNDE MIDEA ELECTRIC SCIENCE AND TECHNOLOGY CO., LTD., Foshan (CN); GD MIDEA AIR-CONDITIONING EQUIPMENT CO., LTD., Foshan (CN)

(72) Inventors: Wujun Zhang, Foshan (CN); Jing Wang, Foshan (CN)

(73) Assignees: FOSHAN SHUNDE MIDEA ELECTRIC SCIENCE AND TECHNOLOGY CO., LTD., Foshan (CN); GD MIDEA AIR-CONDITIONING EQUIPMENT CO., LTD., Foshan (CN)

( * ) Notice: Subject to any disclaimer, the term of this patent is extended or adjusted under 35 U.S.C. 154(b) by 335 days.

(21) Appl. No.: 18/688,150

(22) PCT Filed: Jun. 14, 2022

(86) PCT No.: PCT/CN2022/098740
§ 371 (c)(1),
(2) Date: Feb. 29, 2024

(87) PCT Pub. No.: WO2023/045419
PCT Pub. Date: Mar. 30, 2023

(65) Prior Publication Data

US 2025/0003620 A1 Jan. 2, 2025

(30) Foreign Application Priority Data

Sep. 26, 2021 (CN) ..... 202111128620.X
Sep. 26, 2021 (CN) ..... 202111130242.9

(51) Int. Cl.
*F24F 11/64* (2018.01)
*F24F 7/003* (2021.01)
(Continued)

(52) U.S. Cl.
CPC ..... *F24F 11/64* (2018.01); *F24F 7/003* (2021.01); *F24F 7/06* (2013.01); *F24F 8/108* (2021.01); *F24F 11/77* (2018.01)

(58) Field of Classification Search
CPC . F04D 27/00; F04D 29/70; F24F 11/75; F24F 11/64; F24F 11/61; F24F 11/77; F24F 7/003; F24F 8/108; F24F 7/06
See application file for complete search history.

(56) References Cited

U.S. PATENT DOCUMENTS 9,702,577 B1 * 7/2017 Lachapelle ..... F24F 11/77
2015/0306533 A1 * 10/2015 Matlin ..... F24F 8/158 96/417

(Continued)

FOREIGN PATENT DOCUMENTS

CN 203404845 U 1/2014
CN 104949293 A 9/2015

(Continued)

OTHER PUBLICATIONS

First Office Action dated Feb. 20, 2025 received in Chinese Patent Application No. 202111130242.9.

(Continued)

*Primary Examiner* — Chad G Erdman
*Assistant Examiner* — Bhaskar Kakarla
(74) *Attorney, Agent, or Firm* — Scully, Scott, Murphy & Presser, P.C.

(57) ABSTRACT

An air supply device and a control method are disclosed. Different types of filter assemblies can be mounted in the air supply device, each filter assembly includes a filter screen, (Continued)

and the types and/or the quantities of the filter screens of filter assemblies are different. The control method includes: receiving an air supply starting instruction, and obtaining the type of a current filter assembly; obtaining a preset rotating speed corresponding to the type of the current filter assembly; and driving a fan of the air supply device to rotate at the preset rotating speed.

17 Claims, 4 Drawing Sheets

(51) Int. Cl.

| | |
|---|---|
| ***F24F 7/06*** | (2006.01) |
| ***F24F 8/108*** | (2021.01) |
| ***F24F 11/77*** | (2018.01) |

(56) References Cited

U.S. PATENT DOCUMENTS

| | | | | |
|---|---|---|---|---|
| 2017/0144097 | A1* | 5/2017 | Wang | F24F 8/108 |
| 2018/0154297 | A1* | 6/2018 | Maletich | F24F 8/10 |

FOREIGN PATENT DOCUMENTS

| | | | |
|---|---|---|---|
| CN | 106440210 | A | 2/2017 |
| CN | 111059736 | A | 4/2020 |
| CN | 113123989 | A | 7/2021 |
| CN | 113847719 | A | 12/2021 |
| JP | 2001286717 | A | 10/2001 |
| JP | 2009174815 | A | 8/2009 |
| WO | 2018040527 | A1 | 3/2018 |

OTHER PUBLICATIONS

International Search Report dated Aug. 1, 2022 issued in PCT/CN2022/098740.

Chinese Office Action dated Jul. 11, 2022 issued in CN 202111128620.X.

Chinese Office Action dated Oct. 25, 2022 issued in CN 202111128620.X.

Chinese Office Action dated Feb. 16, 2023 issued in CN 202111128620.X.

* cited by examiner

AIR SUPPLY DEVICE AND CONTROL METHOD THEREFOR

CROSS-REFERENCE TO RELATED APPLICATION

This application claims the priority of the Chinese patent application No. 202111128620.X, filed Sep. 26, 2021, and entitled "air supply device and control method therefor" and the priority of the Chinese patent application No. 202111130242.9, filed Sep. 26, 2021, and entitled "air supply device and control method therefor", the entire contents of which are incorporated herein by reference.

TECHNICAL FIELD

The present disclosure relates to the field of electrical equipment, and in particular to an air supply device and a control method therefor.

BACKGROUND

Currently, users have increasingly high requirements for air quality, and many households adopt fresh air machines or air conditioners with fresh air function for indoor and outdoor air circulation to keep the indoor air fresh. A filter assembly is usually mounted in a fresh air machine or an air conditioner. The filter assembly is configured to filter airflow output by the fresh air machine or the air conditioner to remove the solid dirt in the airflow.

In order to meet different filtering needs of users, some fresh air machines or air conditioners may be equipped with different types of filter assemblies, and some may be equipped with different numbers of filter assemblies according to the filtering needs. When the numbers or types of filter assemblies change, the resistance to air will change accordingly, and fans of the fresh air machines or air conditioners usually supply air at a fixed speed. Thus, the output air volume will change accordingly, which readily leads to an excessive output air volume and overly loud noises, or leads to a small output air volume and that the wind speed may not fulfill the basic requirements.

SUMMARY

The following is an overview of the subject described in detail herein. This overview is not intended to limit the scope of protection of the claims.

An embodiment of the present disclosure is to provide a control method for an air supply device and the air supply device, to solve the existing technical problem of loud noise or small air volume caused by the mismatch between a fan rotating speed and an actually mounted filter assembly.

In order to address the above problem, an embodiment of the present disclosure provides a control method for an air supply device. The method includes the steps of:

receiving an air supply starting instruction, and acquiring a type of a current filter assembly;

acquiring a preset rotating speed corresponding to the type of the current filter assembly; and driving a fan of the air supply device to rotate at the preset rotating speed.

In an illustrative embodiment, under a same fan speed gear, the higher the preset rotating speed is, the greater the resistance of the filter assembly of the type corresponding to the preset rotating speed to an airflow is.

In an illustrative embodiment, there are multiple gears of fan speed, and preset rotating speeds corresponding to a same type of filter assembly are different under different fan speed gears;

the air supply starting instruction includes information about a set fan speed gear; and acquiring a preset rotating speed corresponding to the type of the current filter assembly includes: acquiring a preset rotating speed corresponding to the type of the current filter assembly under the set fan speed gear.

In an illustrative embodiment, the air supply device further includes a detection assembly, and the type of the current filter assembly is detected by the detection assembly.

In an illustrative embodiment, the detection assembly includes multiple position switches, and the multiple position switches are in one-to-one correspondence with filter screens capable of being mounted in the air supply device, where in response to any one of the filter screens being mounted in place, a corresponding position switch is triggered; and multiple types of filter assemblies are in one-to-one correspondence with multiple combinations of triggered position switches.

The control method includes:

acquiring, according to a combination of triggered position switches, a type of a filter assembly corresponding to the combination and saving the type as the type of the current filter assembly.

In an illustrative embodiment, the multiple types of filter assemblies are in one-to-one correspondence with multiple rotating speed groups, and each rotating speed group includes multiple preset rotating speed gears, where multiple preset rotating speeds are in one-to-one correspondence with multiple fan speed gears;

as the resistance of the filter assembly type corresponding to the speed rotating group to an airflow increases, all preset rotating speeds corresponding to at least one fan speed gear tend to increase;

the air supply starting instruction includes information about a set fan speed gear; and acquiring a preset rotating speed corresponding to the type of the current filter assembly includes:

selecting, according to the set fan speed gear and the type of the current filter assembly, a preset rotating speed corresponding to the set fan speed gear from the rotating speed group corresponding to the type of the current filter assembly as a preset rotating speed to be executed by the fan.

In an illustrative embodiment, one of the multiple types of the filter assemblies corresponds to a basic rotating speed group, and all the remaining types are in one-to-one correspondence with multiple variable groups;

the basic rotating speed group includes multiple preset rotating speeds in one-to-one correspondence with the multiple fan speed gears;

the variable group includes multiple variables in one-to-one correspondence with the multiple fan speed gears;

the air supply starting instruction includes information about a set fan speed;

acquiring a preset rotating speed corresponding to the type of the current filter assembly includes:

in response to the type of the current filter assembly being the type corresponding to the basic rotating speed group, selecting a preset rotating speed corresponding to the set fan speed gear from the basic rotating speed group as a preset rotating speed to be executed by the fan; and in response to the type of the current filter assembly not being the type corresponding to the basic rotating speed group, selecting a variable corresponding to the set fan speed gear from a variable group corresponding to the type of the filter assembly, selecting a preset rotating speed corresponding to the set fan speed gear from the basic rotating speed group, and adding the variable to the preset rotating speed for acquiring a preset rotating speed to be executed by the fan, and under at least one fan speed gear, the preset rotating speed to be executed by the fan tends to increase with an increasing of the resistance of the type of the current filter assembly to the airflow.

An embodiment of the present disclosure provides an air supply device, including:

a cabinet, internally provided with a runner;

a filter assembly, including a filter screen disposed in the runner;

a fan, disposed in the runner; and a controller, electrically connected to the fan and configured to control the air supply device according to the control method described above.

In an illustrative embodiment, the air supply device further includes a detection assembly, the detection assembly includes multiple position switches which are all electrically connected to the controller, and the multiple position switches are in one-to-one correspondence with multiple filter screens capable of being mounted in the air supply device;

the position switch is configured to be triggered in response to a corresponding filter screen being mounted in place on the air supply device; and the controller is configured to acquire a type of a filter assembly corresponding to a combination of triggered position switches and save the type as a type of a current filter assembly.

In an illustrative embodiment, the air supply device is a fresh air machine or an air conditioner with a fresh air function.

In a technical scheme of the present disclosure, after acquiring the preset rotating speed corresponding to the information about the type of the current filter assembly, the fan is driven to rotate according to the preset rotating speed, and the fan drives the air to flow. Moreover, because the preset rotating speed matches the type of the current filter assembly, the output air volume of the air supply device will not be too large or too small, which can avoid the situation of excessive noise due to excessive output air volume or the situation of not being able to satisfy the basic air speed requirement due to too small air volume.

In order to achieve the above object, an embodiment of the present disclosure further provides a control method for an air supply device, including the steps of:

driving a fan of the air supply device to rotate at a test rotating speed, and measuring a power parameter of the fan;

taking a type of a filter assembly which is preset and corresponds to the power parameter as a type of a current filter assembly;

acquiring a preset rotating speed corresponding to the type of the current filter assembly; and driving the fan of the air supply device to rotate at the preset rotating speed.

In an illustrative embodiment, the power parameter is a current value of the fan or a power value of the fan.

In an illustrative embodiment, multiple value intervals of the power parameter with non-overlapping ranges are preset, and each of the value intervals corresponds to a type of a filter assembly;

taking a type corresponding to the power parameter as a type of a current filter assembly includes:

determining a value interval within which the power parameter falls, acquiring a type of a filter assembly corresponding to the value interval, and taking the type as the type of the current filter assembly.

In an illustrative embodiment, at the test rotating speed of the fan, the greater the resistance of the filter assembly to the airflow is, the greater the value in the value interval corresponding to the type of the filter assembly is.

In an illustrative embodiment, under a same fan speed gear, the higher the preset rotating speed is, the greater the resistance of the filter assembly of the type corresponding to the preset rotating speed to an airflow is.

In an illustrative embodiment, there are multiple gears of fan speed, and preset rotating speeds corresponding to a same type of filter assembly are different under different fan speed gears;

acquiring a preset rotating speed corresponding to the type of the current filter assembly includes: acquiring a preset rotating speed corresponding to the type of the current filter assembly under the set fan speed.

In an illustrative embodiment, multiple types of filter assemblies are in one-to-one correspondence with multiple rotating speed groups, and each rotating speed group includes multiple preset rotating speeds in one-to-one correspondence with multiple fan speeds;

as the resistance of the filter assembly of the type corresponding to the speed rotating group to the airflow increases, all preset rotating speeds corresponding to at least one fan speed gear tend to increase;

acquiring a preset rotating speed corresponding to the type of the current filter assembly includes:

selecting, according to the set fan speed gear and the type of the current filter assembly, a preset rotating speed corresponding to the set fan speed gear from the rotating speed group corresponding to the type of the current filter assembly as a preset rotating speed to be executed by the fan.

In an illustrative embodiment, one of the multiple types of the filter assemblies corresponds to a basic rotating speed group, and all the remaining types are in one-to-one correspondence with multiple variable groups;

the basic rotating speed group includes multiple preset rotating speeds in one-to-one correspondence with multiple fan speed gears;

the variable group includes multiple variables in one-to-one correspondence with the multiple fan speed gears;

acquiring a preset rotating speed corresponding to the type of the current filter assembly includes:

in response to the type of the current filter assembly being the type corresponding to the basic rotating speed group, selecting a preset rotating speed corresponding to the set fan speed gear from the basic rotating speed group as a preset rotating speed to be executed by the fan; and in response to the type of the current filter assembly not being the type corresponding to the basic rotating speed group, selecting a variable corresponding to the set fan speed gear from a variable group corresponding to the type of the filter assembly, selecting a preset rotating speed corresponding to the set fan speed gear from the basic rotating speed group, and adding the variable to the preset rotating speed for acquiring a preset rotating speed to be executed by the fan, and under at least one fan speed gear, the preset rotating speed to be executed by the fan tends to increase with an increasing resistance of the type of the current filter assembly to the airflow.

An embodiment of the present disclosure provides an air supply device, including:

a cabinet, internally provided with a runner in which different types of filter assemblies are capable of being mounted;

a filter assembly, including a filter screen disposed in the runner;

a fan, disposed in the runner;

a detection device, configured to measure a power parameter of the fan; and a controller, electrically connected to the fan and the detection device and configured to control the air supply device according to the control method described above.

In an illustrative embodiment, the detection device is a current measurement device or a power measurement device.

In an illustrative embodiment, the air supply device is a fresh air machine, an air conditioner or an air purifier.

In a technical scheme of the present disclosure, the type of the current filter assembly can be automatically identified according to the power parameter of the fan at the test rotating speed without manually adjusting parameter configuration on the type of the current filter assembly, thus manual operations are reduced and user experience is improved. Meanwhile, after acquiring the preset rotating speed corresponding to the type of the current filter assembly, the fan is driven to rotate according to the preset rotating speed, and the fan drives the air to flow. Moreover, because the preset rotating speed matches the type of the current filter assembly, the output air volume of the air supply device will not be too large or too small, which can avoid the situation of excessive noise due to excessive output air volume or the situation of not being able to satisfy the basic air speed requirement due to too small air volume.

After reading and understanding the drawings and detailed description, other aspects can be understood.

BRIEF DESCRIPTION OF DRAWINGS

In order to more clearly illustrate the technical schemes in the embodiments of the present disclosure or in the existing technology, the embodiments or drawings required in the description of the existing technology will be briefly introduced below. Obviously, the drawings in the description below are only some embodiments of the present disclosure. Those having ordinary skills in the art may also obtain other drawings according to the structures shown in these drawings without creative effort.

Figure 1:
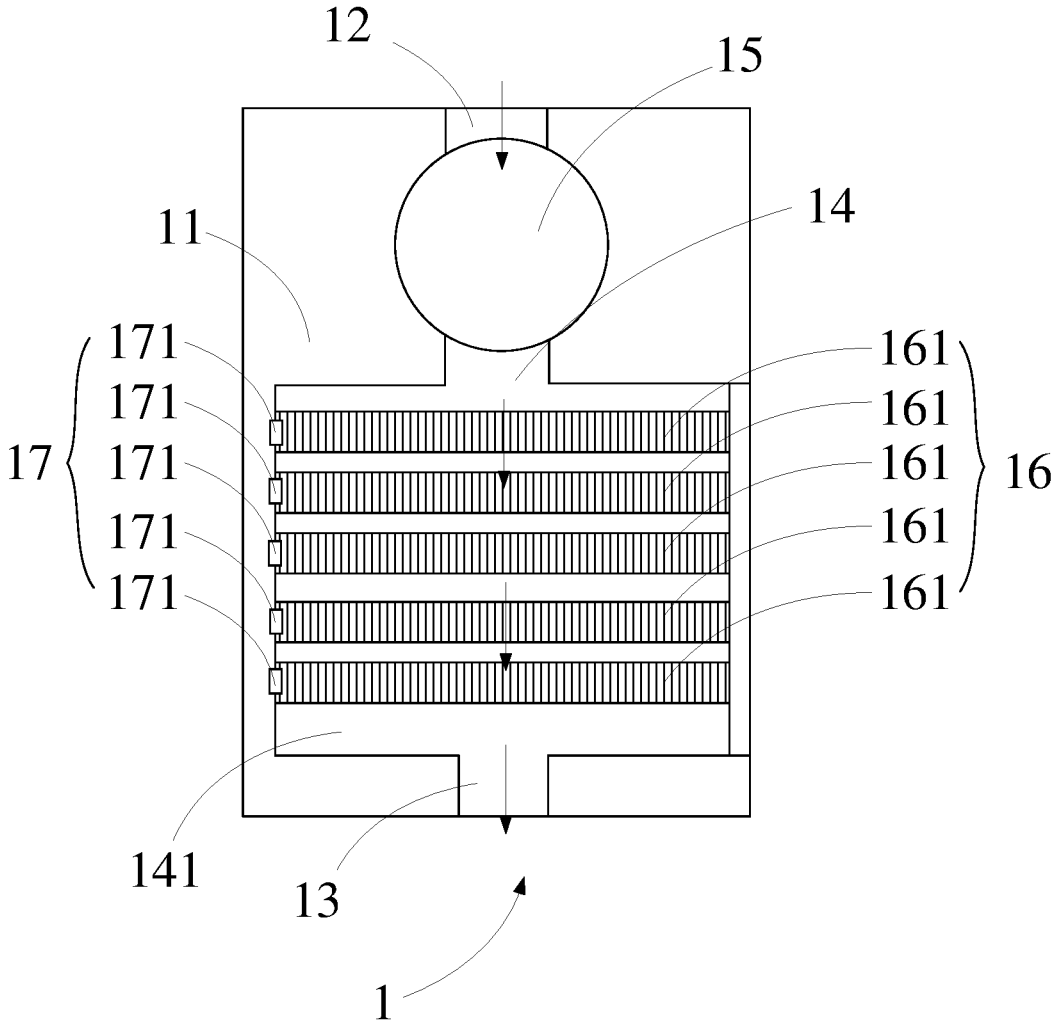
FIG. 1 is a schematic sectional view of an air supply device according to an embodiment of the present disclosure.

Reference numerals:

| Numeral | Name | Numeral | Name |
|---|---|---|---|
| 1 | Air supply device | 11 | Cabinet |
| 12 | Air inlet | 13 | Air outlet |
| 14 | Runner | 141 | Mounting chamber |
| 15 | Fan | 16 | Filter assembly |
| 161 | Filter screen | 17 | Detection assembly |
| 171 | Position switch | 18 | Controller |
| 1a | Air supply device | 11a | Cabinet |
| 12a | Air inlet | 13a | Air outlet |
| 14a | Runner | 141a | Mounting chamber |
| 15a | Fan | 16a | Filter assembly |
| 161a | Filter screen | 17a | Detection device |
| 18a | Controller | | |

The realization of the objects, functional characteristics and advantages of embodiments of the present disclosure will be further described in conjunction with the embodiments and with reference to the accompanying drawings.

DETAILED DESCRIPTION

The technical schemes in the embodiment of the present disclosure will be described clearly and completely below in conjunction with the accompanying drawings in the embodiments of the present disclosure. Obviously, the described embodiments are only some, but not all of the embodiments of the present disclosure. All other embodiments obtained by those having ordinary skills in the art based on the embodiments of the present disclosure without creative effort belong to the protection scope of the present disclosure.

It should be noted that all directional indications (such as "up", "down", "left", "right", "front", "back" and the like) in the embodiments of the present disclosure are only used to illustrate the relative position relationship and movement between components in a specific posture (as shown in the figures). If the specific posture changes, the directional indications also change accordingly.

In addition, terms such as "first", "second" and the like are used herein for purposes of description and are not intended to indicate or imply relative importance or significance or to imply the number of indicated technical features. Thus, the feature defined with "first" and "second" may explicitly or implicitly includes one or more of the features. In the description of the present disclosure, "multiple" means at least two, such as two, three, etc., unless specified otherwise.

In the present disclosure, unless specified or limited otherwise, the terms "connected", "fixed" and the like are used broadly, and "fixed" may refer to, for example, fixed connections, detachable connections, or integral connections; may also refer to mechanical connections, or electric connections; may also refer to direct connections, or indirect connections via intervening structures; may also refer to inner communications in, or interaction between two elements, unless otherwise specifically defined. The specific meaning of the above terms within the present disclosure may be understood by those skilled in the art according to particular circumstances.

In addition, the technical schemes of various embodiments of the present disclosure may be combined with each other, but must be based on what those having ordinary skills in the art can achieve. When the combinations of technical schemes are contradictory or unattainable, it should be considered that such combinations of technical schemes do not exist and are not within the scope of protection claimed by the present disclosure.

Example Embodiment One

FIG. 1 shows a structure of an air supply device 1. The air supply device 1 may be a fresh air machine, an air conditioner or an air purifier. As shown in FIG. 1, the air supply device 1 includes a cabinet 11, a fan 15, a filter assembly 16 and a controller 18.

The cabinet 11 is provided with an air inlet 12, an air outlet 13 and a runner 14. One end of the runner 14 is connected to the air inlet 12, and the other end of the runner 14 is connected to the air outlet 13. The fan 15 is disposed on the runner 14. The fan 15 is configured to drive airflow in the runner 14 such that the airflow flows from the air inlet 12 to the air outlet 13. A mounting chamber 141 is disposed on the runner 14. The filter assembly 16 is disposed in the mounting chamber 141. The filter assembly 16 includes one or more filter screens 161. The filter screen 161 is provided with multiple meshes. The filter assembly 16 is configured to filter out solid impurities in the airflow passing through the filter assembly 16.

In this embodiment, different types of filter assemblies 16 may be mounted in the mounting chamber 141. Different types of filter assemblies 16 may include different types of filter screens 161 and a same number of filter screens 161, or different numbers of filter screens 161 and a same type of filter screens 161, or different types of filter screens 161 and different numbers of filter screens 161.

Different types of filter screens 161 mainly refer to different materials and/or sizes of filter media of the filter screens 161. According to the classification of filter media, the filter screens 161 may be classified into a textile fiber filter screen, a metal filter screen, an activated carbon filter screen, and a High Efficiency Particulate Air Filter (HEPA) screen. The textile fiber filter screen is woven from textile fibers, and the metal filter screen is woven or stamped from metal wires, with meshes in a large size. The activated carbon filter screen is made of activated carbon, which can absorb the odor in the airflow while filtering particulate pollutants. The HEPA screen is 99.7% effective for 0.1 μm and 0.3 μm particulate pollutants. The HEPA screen has the characteristics that air can pass through, but small particles cannot.

Due to different materials and/or sizes, the resistances of the filter screens 161 to the airflow are different. The larger the mesh size of the filter screen 161 is and the greater the mesh number is, the smaller the resistance of the filter screen 161 to the airflow is. The thinner and larger the filter screen 161 is, the smaller the resistance of the filter screen 161 to the airflow is. When the filter assemblies 16 include the same number of filter screens 161 and different types of filter screens 161, the resistances of the filter assemblies 16 to the airflow are usually different. When the filter screens 161 are the same, the more the number of the filter screens 161 in a filter assembly 16 is, the greater the resistance of the filter assembly 16 to the airflow is. Therefore, different types of filter assemblies 16 usually have different resistances to the airflow.

For example, three filter screens 161, namely a first filter screen, a second filter screen, and a third filter screen, may be mounted in the mounting chamber 141 of the air supply device 1, and are of different types. The types of the filter assemblies 16 may refer to S1, S2, S3, S4, S5, S6 and S7, where the filter assembly 16 of a type S1 includes a first filter screen, the filter assembly 16 of a type S2 includes a second filter screen, the filter assembly 16 of a type S3 includes a third filter screen, the filter assembly 16 of a type S4 includes a first and a second filter screens, the filter assembly 16 of a type S5 includes a first and a third filter screens, the filter assembly 16 of a type S6 includes a second and a third filter screens, and the filter assembly 16 of a type S7 includes a first, a second and a third filter screens.

Figure 2:
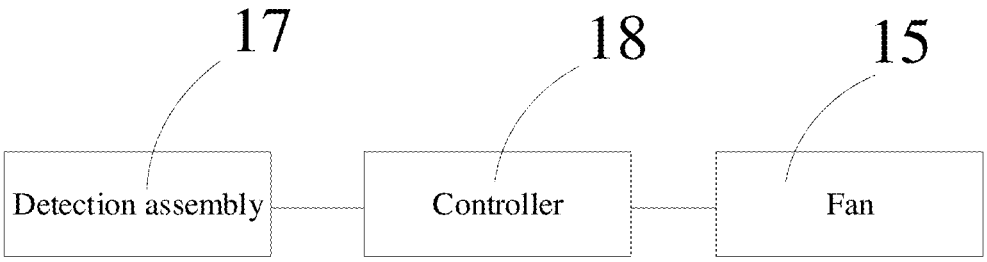
FIG. 2 is a schematic diagram showing electrical connection of an air supply device according to an embodiment of the present disclosure.

As shown in FIG. 2, the controller 18 is electrically connected to the fan 15. The controller 18 may control the fan 15 to start or stop, as well as the rotating speed of the fan 15. The higher the rotating speed of the fan 15 is, the higher an air pressure output by the fan 15 is.

Figure 3:
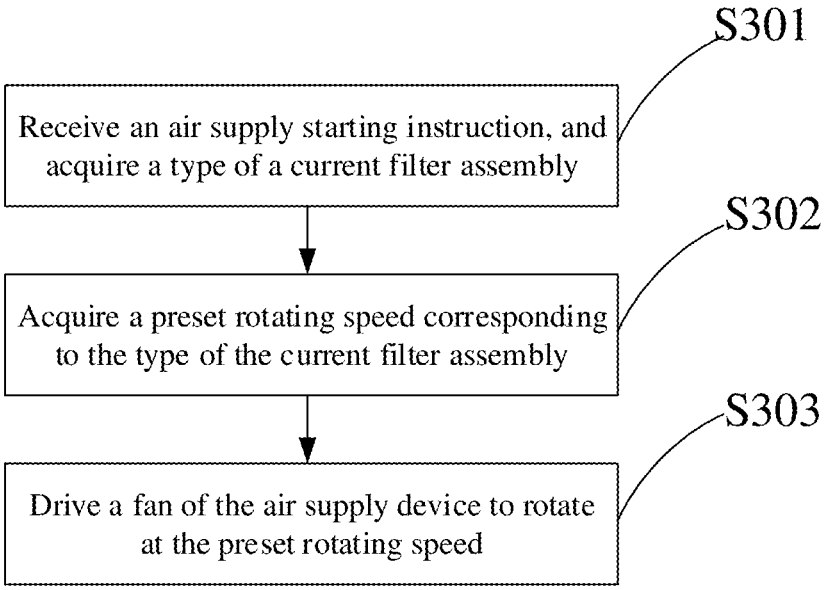
FIG. 3 is a flowchart of a control method according to an embodiment of the present disclosure.

As shown in FIG. 3, this embodiment further provides a control method for an air supply device 1, which is implemented based on the above-mentioned air supply device 1. The control method includes the following steps.

In a step of S301, a controller 18 receives an air supply starting instruction, and acquires information about a type of a current filter assembly.

The air supply starting instruction is used to instruct the controller 18 to drive the fan 15 to supply air. The air supply starting instruction may be sent by a user to the controller 18 through a control panel or a remote control of the air supply device 1. The air supply starting instruction may also be sent through a mobile terminal which may be connected to the controller 18 through a local area network or the Internet. The mobile terminal may be a mobile phone or a tablet computer.

The information about the type of the current filter assembly 16 may be pre-stored in the controller 18 in a manual setting manner. For example, when the air supply device 1 is used for the first time to perform parameter configuration on the air supply device 1, the information about the type of the current filter assembly 16 is input into the controller 18 through a control panel, a remote control or a mobile terminal.

After receiving the air supply starting instruction, the controller 18 retrieves the information about the type of the current filter assembly 16.

In a step of S302, the controller 18 acquires a preset rotating speed corresponding to the information about the type of the current filter assembly 16.

Correspondence between the types of the filter assemblies 16 and multiple preset rotating speeds of the fan 15 is pre-stored in the controller 18, which may be stored in the form of a table.

Different types of filter assemblies 16 correspond to different airflow resistances. The greater the airflow resistance is, the higher the required rotating speed of the fan 15 is. Under a same fan speed gear, the preset rotating speed tends to increase with an increasing resistance of the filter assembly 16 to the airflow.

For example, the types of filter assemblies 16 are S1, S2, and S3, respectively, where the resistance of the filter assembly 16 of a type S1 to the airflow<the resistance of the filter assembly 16 of a type S2 to the airflow<the resistance of the filter assembly 16 of a type S3 to the airflow. The multiple preset rotating speeds are N1, N2, and N3, respectively. The type S1 of the filter assembly 16 corresponds to the preset rotating speed N1, the type S2 of the filter assembly 16 corresponds to the preset rotating speed N2, and the type S3 of the filter assembly 16 corresponds to the preset rotating speed N3. The relationship among N1, N2 and N3 may be N3=N2>N1, or N3>N2>N1, or N3>N2=N1.

The controller 18 may acquire a preset rotating speed corresponding to the current filter assembly 16 according to the type of the current filter assembly 16.

In a step of S303, the controller 18 drives the fan 15 to supply air at the preset rotating speed corresponding to the type of the current filter assembly 16.

After acquiring the preset rotating speed corresponding to the information about the type of the current filter assembly 16, the controller 18 drives the fan 15 to rotate according to the preset rotating speed, and the fan 15 drives the air to flow. Moreover, because the preset rotating speed matches the type of the current filter assembly 16, an output air volume of the air supply device will not be too large or too small, which can avoid the situation of excessive noise due to excessive output air volume or the situation of not being able to satisfy the basic air speed requirement due to too small air volume.

In an embodiment, the controller 18 may be provided with multiple fan speed gears. The multiple fan speed gears may be, for example, "Strong", "High", "Middle" and "Low", respectively. Multiple preset rotating speed gears corresponding to a same type of filter assembly 16 are different under different fan speed gears. For example, under a certain type of filter assembly 16, the preset rotating speed gears corresponding to "Strong", "High", "Middle" and "Low" decrease in sequence.

Under the same fan speed, for example, under any one of the fan speed gears of "Strong", "High", "Middle" and "Low", the higher the preset rotating speed is, the greater the resistance of the filter assembly 16 corresponding to the preset rotating speed to the airflow is.

For example, the types of filter assemblies 16 are S1, S2, and S3, respectively, where the resistance of the filter assembly 16 of a type S1 to the airflow<the resistance of the filter assembly 16 of a type S2 to the airflow<the resistance of the filter assembly 16 of a type S3 to the airflow. Multiple preset rotating speeds are N1, N2, and N3, respectively. The type S1 of the filter assembly 16 corresponds to the preset rotating speed N1, the type S2 of the filter assembly 16 corresponds to the preset rotating speed N2, and the type S3 of the filter assembly 16 corresponds to the preset rotating speed N3. The relationship among N1, N2 and N3 is N3>N2>N1.

In the step of S302, acquiring a preset rotating speed corresponding the type of the current filter assembly 16 includes: acquiring a preset rotating speed corresponding to the type of the current filter assembly 16 at a set fan speed gear.

In the step of S301, the air supply starting instruction includes information about a set fan speed gear. For example, when a user sends the air supply starting instruction to the controller 18 through a remote control or a mobile terminal, a fan speed gear is further selected as the set fan speed gear and carried in the air supply starting instruction.

Multiple fan speed gears are set to enable the user to set the air supply speed of the air supply device 1 as needed. Meanwhile, under the same fan speed gear, the higher the preset rotating speed is, the greater the resistance of the filter assembly 16 corresponding to the preset rotating speed to the airflow is, so the problem of loud noise due to a small resistance of the current filter assembly 16 to the airflow, as well as the problem of low wind outlet speed due to excessive resistance of the current filter assembly 16 to the airflow can be avoided under this fan speed gear.

In another embodiment, the controller 18 may be provided with multiple fan speed gears. The multiple fan speed gears may be, for example, "Strong", "High", "Middle" and "Low", respectively.

The controller 18 is further provided with multiple rotating speed groups. The number of the rotating speed groups is the same as the number of types of filter assemblies 16 that can be mounted in the air supply device 1, and the rotating speed groups are in one-to-one correspondence with the types of filter assemblies 16. Each rotating speed group is provided with multiple preset rotating speed gears, and the number of preset rotating speeds in each rotating speed group is the same as the number of the fan speed gears. Multiple preset wind speeds of each rotating speed group are in one-to-one correspondence with the fan speed gears. In each rotating speed group, as a fan speed gear shifts up, a value of a preset wind speed corresponding to the fan speed increases.

All preset rotating speeds corresponding to at least one fan speed gear tend to increase as the resistance of a filter assembly 16 corresponding to the rotating speed group in which all the preset rotating speeds are included to the airflow increases.

For example, the types of filter assemblies 16 are S1, S2, and S3, respectively, where the resistance of the filter assembly 16 of a type S1 to the airflow<the resistance of the filter assembly 16 of a type S2 to the airflow<the resistance of the filter assembly 16 of a type S3 to the airflow. The multiple rotating speed groups are rotating speed group A, rotating speed group B, and rotating speed group C, respectively. The type S1 of the filter assembly 16 corresponds to the rotating speed group A; the type S2 of the filter assembly 16 corresponds to the rotating speed group B; and the type S3 of the filter assembly 16 corresponds to the rotating speed group C.

Preset rotating speeds included in the rotating speed group A are a1, a2, a3, and a4, where a1>a2>a3>a4. The correspondence between the fan speed gears and the multiple preset rotating speeds included in the rotating speed group A is as follows: "Strong" corresponds to the preset rotating speed a1 in the rotating speed group A, "High" corresponds to the preset rotating speed a2 in the rotating speed group A, "Middle" corresponds to the preset rotating speed a3 in the rotating speed group A, and "Low" corresponds to the preset rotating speed a4 in the rotating speed group A.

Preset rotating speeds included in the rotating speed group B are b1, b2, b3, and b4, where b1>b2>b3>b4. The correspondence between the fan speed gears and the multiple preset rotating speeds included in the rotating speed group B is as follows: "Strong" corresponds to the preset rotating speed b1 in the rotating speed group B, "High" corresponds to the preset rotating speed b2 in the rotating speed group B, "Middle" corresponds to the preset rotating speed b3 in the rotating speed group B, and "Low" corresponds to the preset rotating speed b4 in the rotating speed group B.

Preset rotating speeds included in the rotating speed group C are c1, c2, c3, and c4, where c1>c2>c3>c4. The correspondence between the fan speed gears and the multiple preset rotating speeds included in the rotating speed group C is as follows: "Strong" corresponds to the preset rotating speed c1 in the rotating speed group C, "High" corresponds to the preset rotating speed c2 in the rotating speed group C, "Middle" corresponds to the preset rotating speed c3 in the rotating speed group C, and "Low" corresponds to the preset rotating speed c4 in the rotating speed group C.

The controller 18 has at least one of the following configurations: the preset rotating speeds a1, b1 and c1 tend to increase, for example, a1<b1<c1, or a1<b1=c1, or a1=b1<c1; the preset rotating speeds a2, b2 and c2 tend to increase, for example, a2<b2<c2, or a2<b2=c2, or a2-b2<c2; the preset rotating speeds a3, b3 and c3 tend to increase, for example, a3<b3<c3, or a3<b3=c3, or a3=b3<c3; and the preset rotating speeds a4, b4 and c4 tend to increase, for example, a4<b4<c4, or a4<b4=c4, or a4=b4<c4.

In the step of S301, the air supply starting instruction includes information about a set fan speed gear. For example, when a user sends the air supply starting instruction to the controller 18 through a remote control or a mobile terminal, a fan speed gear is selected as the set fan speed gear and carried in the air supply starting instruction. This fan speed gear may be a fan speed gear set at the last time when the air supply device 1 is started. For example, if the fan speed gear is switched to "Middle" when the air supply device 1 is started last time, the air supply device 1 will be started at "Middle" by default the next time.

In this embodiment, step S302 may include a first substep and a second substep.

In the first substep, according to the type of the current filter assembly 16, the controller 18 acquires a rotating speed group corresponding to the type of the current filter assembly 16. The method proceeds to the second substep.

In the second substep, according to the set fan speed gear in the air supply starting instruction, the controller 18 selects a preset rotating speed corresponding to the set fan speed gear from a rotating speed group corresponding to the type of the current filter assembly 16. The method proceeds to step S303.

For example, when the type of the current filter assembly 16 is S1, and the set fan speed gear is "Middle", the controller 18 acquires the rotating speed group A corresponding to the type S1 when executing the first substep, and selects the preset rotating speed a3 from the rotating speed group A when executing the second substep, the preset rotating speed a3 being a preset rotating speed to be executed by the fan 15 in step S303.

Multiple fan speed gears are provided to enable the user to set the air supply speed of the air supply device 1 as needed. Meanwhile, if all preset rotating speeds corresponding to at least one fan speed gear tend to increase as the resistance of a filter assembly 16 corresponding to the rotating speed group in which all the preset rotating speeds are included to the airflow increases, the problem of loud noise due to a small resistance of the current filter assembly 16 to the airflow, as well as the problem of low wind outlet speed due to excessive resistance of the current filter assembly 16 to the airflow can be avoided under this fan speed gear.

In another embodiment, the controller 18 may be provided with multiple fan speed gears. The multiple fan speed gears may be, for example, "Strong", "High", "Middle" and "Low", respectively.

The controller 18 is further provided with a basic rotating speed group and multiple variable groups. The basic rotating speed group corresponds to a type of a filter assembly 16, the number of the variable groups is the same as the number of types of remaining filter assemblies 16, and the variable groups are in one-to-one correspondence with the types of the remaining filter assemblies 16.

The basic rotating speed group is provided with multiple preset rotating speeds, the number of the preset rotating speeds in the basic rotating speed group is the same as the number of the fan speed gears, and the multiple preset wind speeds are in one-to-one correspondence with the fan speed gears.

Each variable group is provided with multiple variables, the number of variables in each variable group is the same as the number of the fan speed gears, and the multiple variables are in one-to-one correspondence with the fan speed gears. The variables may be positive or negative.

For example, the types of filter assemblies 16 are S1, S2, and S3, respectively, where the resistance of the filter assembly 16 of a type S1 to the airflow<the resistance of the filter assembly 16 of a type S2 to the airflow<the resistance of the filter assembly 16 of a type S3 to the airflow.

The basic rotating speed group corresponds to the type S1 of the filter assembly 16. Preset rotating speeds included in the basic rotating speed group are a1, a2, a3, and a4, respectively, where a1>a2>a3>a4. The correspondence between the multiple preset rotating speeds and the fan speed gears is as follows: "Strong" corresponds to the preset rotating speed a1 in the rotating speed group A, "High" corresponds to the preset rotating speed a2 in the rotating speed group A, "Middle" corresponds to the preset rotating speed a3 in the rotating speed group A, and "Low" corresponds to the preset rotating speed a4 in the rotating speed group A.

The multiple variable groups are variable group B and variable group C, respectively. The type S2 of the filter assembly 16 corresponds to the variable group B; and the type S3 of the filter assembly 16 corresponds to the variable group C.

The variables included in the variable group B are Δb1, Δb2, Δb3, and Δb4, respectively, where Δb1> Δb2>Δb3>Δb4. The correspondence between the fan speed gears and the multiple variables is as follows: "Strong" corresponds to the variable Δb1 in the rotating speed group B, "High" corresponds to the variable Δb2 in the rotating speed group B, "Middle" corresponds to the variable Δb3 in the rotating speed group B, and "Low" corresponds to the variable Δb4 in the rotating speed group B.

The variables included in the variable group C are Δc1, Δc2, Δc3, and Δc4, respectively, where Δc1> Δc2>Δc3>Δc4. The correspondence between the fan speed gears and the multiple variables is as follows: "Strong" corresponds to the variable Δc1 in the rotating speed group C, "High" corresponds to the variable Δc2 in the rotating speed group C, "Middle" corresponds to the variable Δc3 in the rotating speed group C, and "Low" corresponds to the variable Δc4 in the rotating speed group C.

In the step of S301, the air supply starting instruction includes information about a set fan speed gear. For example, when a user sends the air supply starting instruction to the controller 18 through a remote control or a mobile terminal, a fan speed gear is selected as a set fan speed gear and carried in the air supply starting instruction. This fan speed gear may be a fan speed gear set at the last time when the air supply device 1 is started. For example, if the fan speed is switched to "Middle" when the air supply device 1 is started last time, the air supply device 1 will be started at "Middle" by default the next time.

In this embodiment, step S302 may include first to sixth substeps.

In a first substep, the controller 18 determines whether the type of the current filter assembly 16 is a type of a filter assembly 16 corresponding to the basic rotating speed group, if yes, the method proceeds to a second substep, otherwise, the method proceeds to a third substep.

In the second substep, according to the set fan speed gear in the air supply starting instruction, the controller 18 acquires a preset rotating speed corresponding to the set fan speed gear from the basic rotating speed group, and takes the preset rotating speed as a preset rotating speed to be executed by the fan 15. The method proceeds to step S303.

In the third substep, according to the set fan speed gear, the controller 18 acquires a preset rotating speed corresponding to the set fan speed gear from the basic rotating speed group. The method proceeds to a fourth substep.

In the fourth substep, the controller 18 acquires, according to the type of the current filter assembly 16, a variable group corresponding to the type. The method proceeds to a fifth substep.

In the fifth substep, the controller 18 acquires, according to the set fan speed gear in the air supply starting instruction, a variable corresponding to the set fan speed gear from the variable group.

In a sixth substep, the variable is added to the preset rotating speed for acquiring a preset rotating speed to be executed by the fan 15. The method proceeds to step S303.

The preset rotating speed to be executed by the fan 15 is a rotating speed at which the controller 18 drives the fan 15 to rotate in step S303.

In this way, if the type of the current filter assembly 16 is the type corresponding to the basic rotating speed group, the preset rotating speed corresponding to the set fan speed gear in the basic rotating speed group is directly used as the preset rotating speed to be executed by the fan 15 in step S303. If the type of the current filter assembly 16 is the type corresponding to a variable group, a variable corresponding to the set fan speed gear in the variable group and a preset rotating speed corresponding to the set fan speed gear in the basic rotating speed group are acquired, and then the variable is added to the preset rotating speed for acquiring a preset rotating speed to be executed by the fan 15 in step S303.

For example, when the type of the current filter assembly 16 is S1, and the set fan speed gear is "Middle", the controller 18 first determines whether the type S1 of the filter assembly 16 is the type of the filter assembly 16 corresponding to the basic rotating speed group. After determining that the type S1 of the current filter assembly 16 is the type corresponding to the basic rotating speed group, the controller 18 acquires the preset rotating speed a3 corresponding to the "Middle" from the basic rotating speed group, and takes the preset rotating speed a3 as a preset rotating speed to be executed by the fan 15.

When the type of the current filter assembly 16 is S2, and the set fan speed gear is "High", the controller 18 first determines whether the type S2 of the current filter assembly 16 is the type corresponding to the basic rotating speed group. After determining that the type S2 of the filter assembly 16 is not the type of the filter assembly 16 corresponding to the basic rotating speed group, the controller 18 first acquires the preset rotating speed a2 corresponding to the "High" from the basic rotating speed group, then acquires the variable Δb2 corresponding to the "High" from the variable group B corresponding to the type S2 of the filter assembly 16, then calculates the sum of the preset rotating speed a2 and the variable Δb2, and finally takes a calculation result as a preset rotating speed to be executed by the fan 15.

All preset rotating speeds corresponding to at least one fan speed gear tend to increase with the increase of the resistance of the filter assembly 16 of the type corresponding to the rotating speed group in which all the preset rotating speeds are included to the airflow. In this embodiment, there is at least one of the following configurations: the preset rotating speed corresponding to "Strong" tends to increase, a1< (a1+Δb1)< (a1+Δc1), or a1< (a1+Δb1)=(a1+Δc1), or a1=(a1+Δb1)< (a1+Δc1); the preset rotating speed corresponding to "High" tends to increase, for example, a2< (a2+Δb2)< (a2+Δc2), or a2< (a2+Δb2)=(a2+Δc2), or a2= (a2+Δb2)< (a2+Δc2); the preset rotating speed corresponding to "Middle" tends to increase, for example, a3< (a3+Δb3)< (a3+Δc3), or a3< (a3+Δb3)=(a3+Δc3); and the preset rotating speed corresponding to "Low" tends to increase, for example, a4<b4<c4, or a4<b4=c4, or a4=b4<c4.

Multiple fan speed gears are provided to enable the user to set the air supply speed of the air supply device 1 as needed. Meanwhile, if all preset rotating speeds corresponding to at least one fan speed gear tend to increase with the increase of the resistance of a filter assembly 16 corresponding to the rotating speed group in which all the preset rotating speeds are included to the airflow increases, the problem of loud noise due to a small resistance of the current filter assembly 16 to the airflow, as well as the problem of low wind outlet speed due to excessive resistance of the current filter assembly 16 to the airflow can be avoided under this fan speed gear.

In an embodiment, the air supply device 1 further includes a detection assembly 17. The detection assembly 17 is electrically connected to the controller 18. The detection assembly 17 is configured to detect a type of a current filter assembly 16 and send the type of the current filter assembly 16 to the controller 18.

The detection assembly 17 includes multiple position switches 171. The multiple position switches 171 are all electrically connected to the controller 18. The multiple position switches 171 are all disposed in a mounting chamber 141. The position switches 171 are disposed in one-to-one correspondence with filter screens 161. In the mounting chamber 141, a position switch 171 is correspondingly arranged in a mounting position of each filter screen 161. When the filter screen 161 is mounted in a corresponding mounting position, the filter screen 161 compresses the position switch 171 in the mounting position to trigger the position switch 171.

After each position switch 171 is triggered, trigger signals are sent to the controller 18. The controller 18 can determine triggered position switch 171 according to the received trigger signals. Combinations of position switches 171 are in one-to-one correspondence with the types of the filter assemblies 16. The correspondence between the combinations of the position switches 171 and the types of the filter assemblies 16 is pre-stored in the controller 18.

For example, three filter screens 161 may be mounted in the mounting chamber 141 of the air supply device 1, which are a first filter screen, a second filter screen, and a third filter screen, respectively. The types of the filter assemblies 16 may be S1, S2, S3, S4, S5, S6 and S7, where the filter assembly 16 of a type S1 includes a first filter screen, the filter assembly 16 of a type S2 includes a second filter screen, the filter assembly 16 of a type S3 includes a third filter screen, the filter assembly 16 of a type S4 includes a first and a second filter screens, the filter assembly 16 of a type S5 includes a first and a third filter screens, the filter assembly 16 of a type S6 includes a second and a third filter screens, and the filter assembly 16 of a type S7 includes a first, a second, and a third filter screens.

The multiple position switches 171 are a first position switch, a second position switch, and a third position switch, respectively. The first, second, and third position switches correspond to the first, second, and third filter screens, respectively. The combinations of position switches 171 may be s1, s2, s3, s4, s5, s6 and s7, where the combination s1 of position switches 171 includes first position switches, the combination s2 of position switches 171 includes second position switches, the combination s3 of position switches 171 includes third position switches, the combination s4 of position switches 171 includes first and second position switches, the combination s5 of position switches 171 includes first and third position switches, the combination s6 of position switches 171 includes second and third position switches, and the combination s7 of position switches 171 includes first, second, and third position switches.

In this way, the combination s1 of position switches 171 corresponds to the type S1 of the filter assembly 16, the combination s2 of position switches 171 corresponds to the type S2 of the filter assembly 16, the combination s3 of position switches 171 corresponds to the type S3 of the filter assembly 16, the combination s4 of position switches 171 corresponds to the type S4 of the filter assembly 16, the combination s5 of position switches 171 corresponds to the type S5 of the filter assembly 16, the combination s6 of position switches 171 corresponds to the type S6 of the filter assembly 16, and the combination s7 of position switches 171 corresponds to the type S7 of the filter assembly 16.

Before acquiring the type of the current filter assembly 16, the control method further includes:

acquiring, according to a combination of triggered position switches 171, a type of a filter assembly 16 corresponding to the combination, and saving the type as the type of the current filter assembly 16.

The controller 18 may obtain a type of a filter assembly 16 corresponding to the combination of triggered position switches 171 according to the combination of triggered position switches 171 and the correspondence between the combinations of position switches 171 and the types of the filter assemblies 16, and take the type as the type of the current filter assembly 16.

For example, when the triggered position switches 171 are the first and third position switches, the combination of position switches 171 corresponding to the first and third position switches is s5, and the type of the filter assembly 16 corresponding to the combination of position switches 171 is S5. Therefore, the type S5 of the filter assembly 16 is taken as the type of the current filter assembly 16.

Thus, the type of the current filter assembly 16 can be automatically detected by the detection assembly 17 without manually performing parameter configuration on the current filter assembly 16, reducing manual operations and improving the user experience.

It should be noted that the above-mentioned control method for an air supply device 1 may be applied to the air supply device 1 of this embodiment, and any example for illustration of the above-mentioned control method may be applied to illustrate the air supply device 1 of this embodiment, which will not be repeated here.

Example Embodiment Two

Figure 4:
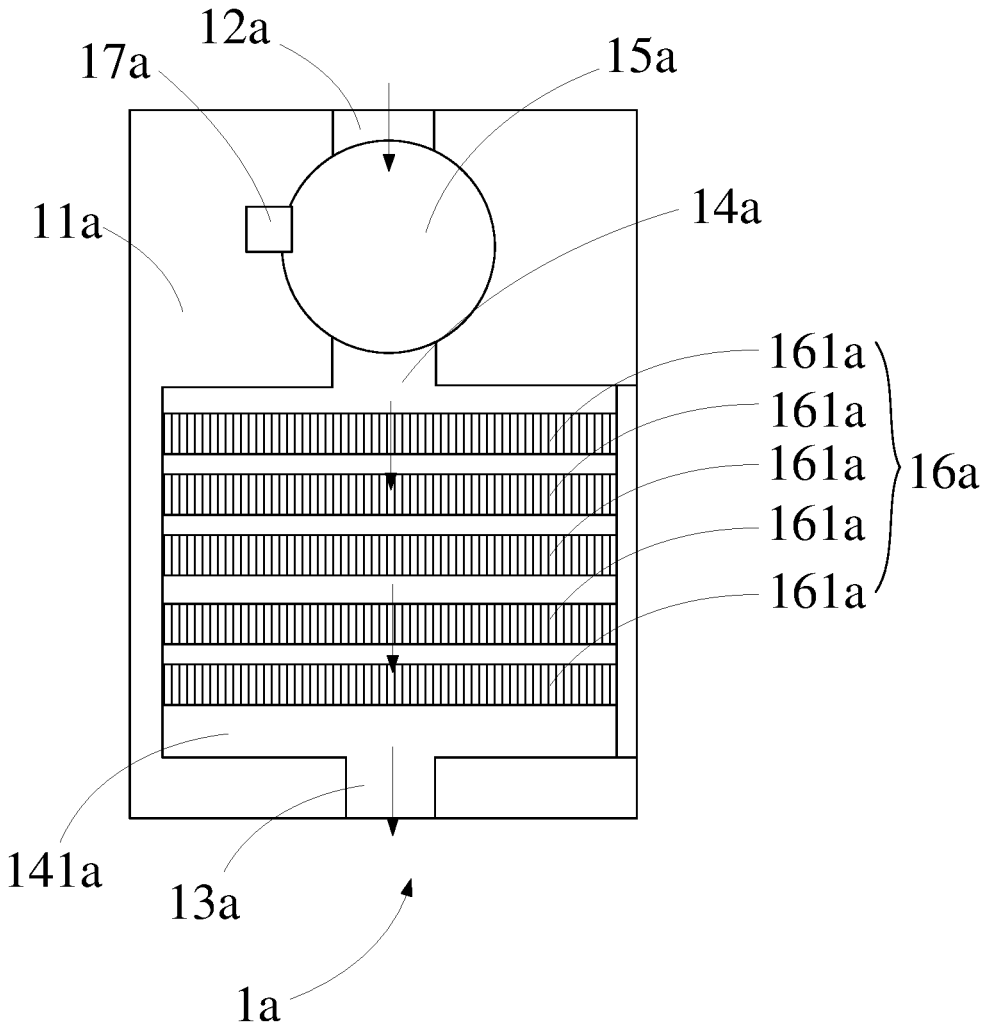
FIG. 4 is a schematic sectional view of an air supply device according to an embodiment of the present disclosure.

As shown in FIG. 4, FIG. 4 shows a structure of an air supply device 1*a*. The air supply device 1*a* may be a fresh air machine, an air conditioner or an air purifier. The air supply device 1*a* includes: a cabinet 11*a*, a fan 15*a*, a filter assembly 16*a*, a controller 18*a* and a detection device 17*a*.

The cabinet 11*a* is provided with an air inlet 12*a*, an air outlet 13*a* and a runner 14*a*. One end of the runner 14*a* is connected to the air inlet 12*a*, and the other end of the runner 14*a* is connected to the air outlet 13*a*. The fan 15*a* is disposed on the runner 14*a*. The fan 15*a* is configured to drive airflow in the runner 14*a* such that the airflow flows from the air inlet 12*a* to the air outlet 13*a*. A mounting chamber 141*a* is disposed on the runner 14*a*. The filter assembly 16*a* is disposed in the mounting chamber 141*a*. The filter assembly 16*a* includes one or more filter screens 161*a*. The filter screen 161*a* is provided with multiple meshes. The filter assembly 16*a* is configured to filter out solid impurities in the airflow passing through the filter assembly 16*a*.

In this embodiment, different types of filter assemblies 16*a* may be mounted in the mounting chamber 141*a*. Different types of filter assemblies 16*a* may include different types of filter screens 161*a* and a same number of filter screens 161*a*, or different numbers of filter screens 161*a* and a same type of filter screens 161*a*, or different types of filter screens 161*a* and different numbers of filter screens 161*a*.

Different types of filter screens 161*a* mainly refer to different materials and/or sizes of filter media of filter screens 161*a*. According to the classification of filter media, filter screens 161*a* may be classified into a textile fiber filter screen, a metal filter screen, an activated carbon filter screen, and a High Efficiency Particulate Air Filter (HEPA) screen. The textile fiber filter screen is woven from textile fibers, and the metal filter screen is woven or stamped from metal wires with meshes in a large size. The activated carbon filter screen is made of activated carbon, which can absorb the odor in the airflow while filtering particulate pollutants. The HEPA screen is 99.7% effective for 0.1 μm and 0.3 μm particulate pollutants. The HEPA screen has the characteristics that air can pass through, but small particles cannot.

Due to different materials and/or sizes, the resistances of the filter screens 161*a* to the airflow are different. The larger the mesh size of the filter screen 161*a* is and the greater the mesh number is, the smaller the resistance of the filter screen 161*a* to the airflow is. The thinner and larger the filter screen 161*a* is, the smaller the resistance of the filter screen 161*a* to the airflow is. When the filter assemblies 16*a* include the same number of filter screens 161*a* and different types of filter screens 161*a*, the resistances of the filter assemblies 16*a* to the airflow are usually different. When the filter screens 161*a* are the same, the more the number of the filter screens 161*a* in a filter assembly 16*a* is, the greater the resistance of the filter assembly 16*a* to the airflow is. Therefore, different types of filter assemblies 16*a* usually have different resistances to the airflow.

For example, the three filter screens 161*a*, namely the first filter screen, the second filter screen, and the third filter screen, may be mounted in the mounting chamber 141*a* of the air supply device 1*a*, and are of different types. The types of the filter assemblies 16*a* may be S1, S2, S3, S4, S5, S6 and S7, where the filter assembly 16*a* of a type S1 includes a first filter screen, the filter assembly 16*a* of a type S2 includes a second filter screen, the filter assembly 16*a* of a type S3 includes a third filter screen, the filter assembly 16*a* of a type S4 includes a first and a second filter screens, the filter assembly 16*a* of a type S5 includes a first and a third filter screens, the filter assembly 16*a* of a type S6 includes a second and a third filter screens, and the filter assembly 16*a* of a type S7 includes a first, a second, and a third filter screens.

Figure 5:
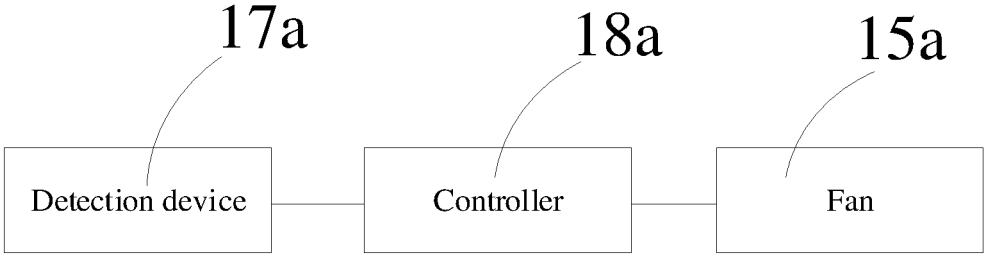
FIG. 5 is a schematic diagram showing electrical connection of an air supply device according to an embodiment of the present disclosure.

As shown in FIG. 5, the controller 18*a* is electrically connected to the fan 15*a*. The controller 18*a* may control the fan 15*a* to start or stop, as well as the rotating speed of the fan 15*a*. The higher the rotating speed of the fan 15*a* is, the higher an air pressure output by the fan 15*a* is.

The detection device 17*a* is electrically connected to the controller 18*a*. The detection device 17*a* is configured to detect a power parameter of the fan 15*a* and send the detected power parameter to the controller 18*a*. The detection device 17*a* may be connected to a power supply line of the fan 15*a*. The detection device 17*a* may be a current measurement device, and the power parameter may be a current value of the fan 15*a*. The detection device 17*a* may also be a power measurement device, and the power parameter may also be a power value of the fan 15*a*.

Figure 6:
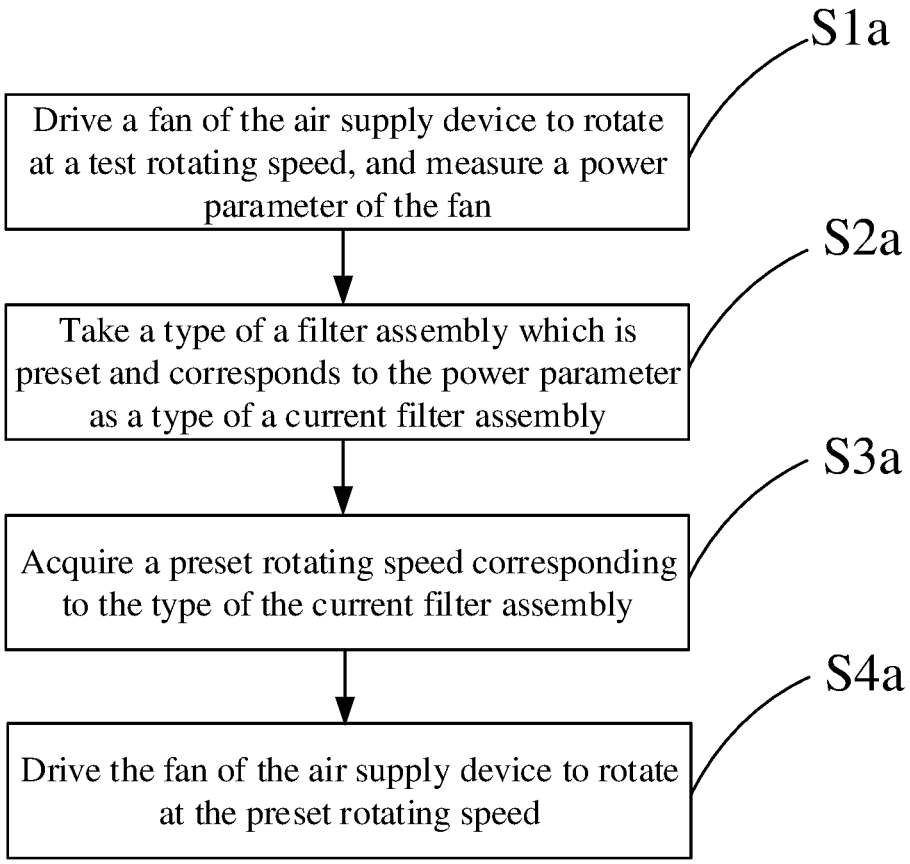
FIG. 6 is a flowchart of a control method according to an embodiment of the present disclosure.

As shown in FIG. 6, this embodiment further provides a control method for an air supply device 1*a*, which is implemented based on the above-mentioned air supply device 1*a*. The control method includes the following steps.

In a step of S1*a*, a controller 18*a* receives an air supply starting instruction, drives a fan 15*a* of the air supply device 1*a* to rotate at a test rotating speed, and measures a power parameter of the fan 15*a*.

The air supply starting instruction is used to instruct the controller 18*a* to drive the fan 15*a* to supply air. The air supply starting instruction may be sent by a user to the controller 18*a* through a control panel or a remote control of the air supply device 1*a*. The air supply starting instruction may also be sent through a mobile terminal which may be connected to the controller 18*a* through a local area network or the Internet. The mobile terminal may be a mobile phone or a tablet computer.

After receiving the air supply starting instruction, the controller 18 drives the fan 15*a* of the air supply device 1*a* to rotate at a preset test rotating speed. The fan 15*a* rotates smoothly at the test rotating speed, and then the controller 18*a* measures the power parameter of the fan 15*a* through a detection device 17*a*. The power parameter is a current value of the fan 15*a* or a power value of the fan 15*a*.

In a step of S2*a*, the controller 18*a* takes a type of a filter assembly 16*a* corresponding to the power parameter as a type of a current filter assembly 16*a*.

The type of the current filter assembly 16*a* is a type of a filter assembly 16*a* currently mounted in the air supply device 1*a*. The type of the filter assembly 16*a* correspond to the power parameter. Different types of filter assemblies 16*a* have different resistances to the airflow. The greater the resistance of the filter assembly 16*a* mounted in the air supply device 1*a* to the airflow is, the greater the load of the fan 15*a* is, and the larger the power parameter of the fan 15*a* at the same test rotating speed is. That is, there is a correspondence between the power parameter and the type of the filter assembly 16*a* at the test rotating speed of the fan 15*a*. The correspondence between the power parameter and the type of the filter assembly 16*a* is prestored in the controller 18*a*.

The controller 18*a* may query a type of a filter assembly 16*a* corresponding to the power parameter from the correspondence between the power parameter and the type of the filter assembly 16*a* according to the power parameter measured at the test rotating speed of the fan 15*a*, and take the type as the type of the current filter assembly 16*a*.

In a step of S3*a*, the controller 18*a* acquires a preset rotating speed corresponding to the type of the current filter assembly 16*a*.

Correspondence between the types of the filter assemblies 16*a* and multiple preset rotating speeds of the fan 15*a* are pre-stored in the controller 18*a*, which may be stored in the form of a table.

Different types of filter assemblies 16*a* correspond to different airflow resistances. The greater the airflow resistance is, the higher the required rotating speed of the fan 15*a* is. Under a same fan speed gear, the preset rotating speed tends to increase with an increasing resistance of the filter assembly 16*a* to the airflow.

For example, the types of filter assemblies 16*a* are S1, S2, and S3, respectively, where the resistance of the filter assembly 16*a* of a type S1 to the airflow<the resistance of the filter assembly 16*a* of a type S2 to the airflow<the resistance of the filter assembly 16*a* of a type S3 to the airflow. The multiple preset rotating speeds are N1, N2, and N3, respectively. The type S1 of the filter assembly 16*a* corresponds to the preset rotating speed N1, the type S2 of the filter assembly 16*a* corresponds to the preset rotating speed N2, and the type S3 of the filter assembly 16*a* corresponds to the preset rotating speed N3. The relationship among N1, N2, and N3 may be N3=N2>N1, or N3>N2>N1, or N3>N2=N1.

The controller 18*a* may acquire a preset rotating speed corresponding to the current filter assembly 16*a* according to the type of the current filter assembly 16*a*.

In a step of S4*a*, the controller 18*a* drives the fan 15*a* to supply air at the preset rotating speed corresponding to the type of the current filter assembly 16*a*.

The controller 18*a* can automatically identify the type of the current filter assembly 16*a* according to the power parameter of the fan 15*a* at the test rotating speed without manually adjusting parameter configuration on the current filter assembly 16*a*, thus manual operations are reduced and the user experience is improved. After acquiring the preset rotating speed corresponding to the type of the current filter assembly 16*a*, the controller 18*a* drives the fan 15*a* to rotate according to the preset rotating speed, and the fan 15*a* drives the air to flow. Moreover, because the preset rotating speed matches the type of the current filter assembly 16*a*, the output air volume of the air supply device 1*a* will not be too large or too small, which can avoid the situation of excessive noise due to excessive output air volume or the situation of not being able to satisfy the basic air speed requirement due to too small air volume.

In an illustrative embodiment, multiple value intervals of the power parameter are stored in the controller. A value interval is a value range of the power parameter. A value interval may be a continuous value range, such as [1, 2]. The value ranges of multiple value intervals do not overlap with each other. The number of value intervals is the same as that of the types of filter assemblies 16*a* that can be mounted in the air supply device 1*a*. The multiple value intervals are in one-to-one correspondence with the types of the filter assemblies 16*a*. The greater the resistance of a filter assembly 16*a* to the airflow is, the greater the value in the value interval corresponding to the filter assembly 16*a* is.

For example, the types of filter assemblies 16*a* are S1, S2, and S3, respectively, where the resistance of the filter assembly 16*a* of a type S1 to the airflow<the resistance of the filter assembly 16*a* of a type S2 to the airflow<the resistance of the filter assembly 16*a* of a type S3 to the airflow. If the multiple value intervals are [0, F1], (F1, F2], and (F2, +00), where 0<F1<F2, the values in [0, F1], (F1, F2], and (F2, +∞) increase in sequence. [0, F1] corresponds to the type S1, (F1, F2] corresponds to the type S2, and (F2, +∞) corresponds to the type S3.

In this embedment, step S2*a* may include a first substep and a second substep.

In the first substep, the controller 18*a* determines a value interval where the measured power parameter falls.

After the power parameter is measured, the controller 18*a* compares a value of the power parameter with the multiple value intervals in sequence, and a value interval within which the value of the power parameter falls is determined as the value interval of the power parameter.

In the second substep, the controller 18*a* acquires a type of a filter assembly 16*a* corresponding to the value interval, and takes the type as the type of the current filter assembly 16*a*.

After determining the value interval in the first substep, the controller 18*a* inquires a type corresponding to the value interval according to a correspondence between the value interval and the type of the filter assembly 16*a*, and then takes the type as the type of the current filter assembly 16*a*.

In an embodiment, the controller 18*a* may be provided with multiple fan speed gears. The multiple fan speed gears may be, for example, "Strong", "High", "Middle" and "Low", respectively. Multiple preset rotating speeds corresponding to filter assemblies 16*a* of the same type are different under different fan speed gears. For example, under a certain type of filter assembly 16*a*, the preset rotating speeds corresponding to "Strong", "High", "Middle" and "Low" decrease in sequence.

Under the same fan speed gear, for example, under any one of the fan speed gears of "Strong", "High", "Middle" and "Low", the higher the preset rotating speed is, the greater the resistance of the filter assembly 16 corresponding to the preset rotating speed to the airflow is.

For example, the types of filter assemblies 16*a* are S1, S2, and S3, respectively, where the resistance of the filter assembly 16*a* of a type S1 to the airflow<the resistance of the filter assembly 16*a* of a type S2 to the airflow<the resistance of the filter assembly 16*a* of a type S3 to the airflow. Multiple preset rotating speeds are N1, N2, and N3, respectively. The type S1 of the filter assembly 16*a* corresponds to the preset rotating speed N1, the type S2 of the filter assembly 16*a* corresponds to the preset rotating speed N2, and the type S3 of the filter assembly 16*a* corresponds to the preset rotating speed N3. The relationship among N1, N2 and N3 is N3>N2>N1.

In the step of S3*a*, acquiring a preset rotating speed corresponding to the type of the current filter assembly 16*a* includes: acquiring a preset rotating speed corresponding to the type of the current filter assembly 16*a* at a set fan speed gear.

In the step of S1*a*, the air supply starting instruction includes information about a set fan speed gear. For example, when a user sends the air supply starting instruction to the controller 18*a* through a remote control or a mobile terminal, a fan speed gear is also selected as the set fan speed gear and carried in the air supply starting instruction.

Multiple fan speed gears are provided to enable the user to set the air supply speed of the air supply device 1*a* as needed. Meanwhile, under the same fan speed gear, the higher the preset rotating speed is, the greater the resistance of the filter assembly 16*a* to the airflow is. Thus, the problem of loud noise due to a small resistance of the current filter assembly 16 to the airflow, as well as the problem of low wind outlet speed due to the excessive resistance of the current filter assembly 16*a* to the airflow can be avoided under this fan speed gear.

In another embodiment, the controller 18*a* may be provided with multiple fan speed gears. The multiple fan speeds may be, for example, "Strong", "High", "Middle" and "Low", respectively.

The controller 18*a* is further provided with multiple rotating speed groups. The number of the rotating speed groups is the same as the number of types of filter assemblies 16*a* that can be mounted in the air supply device 1*a*, and the rotating speed groups are in one-to-one correspondence with the types of filter assemblies 16*a*. Each rotating speed group is provided with multiple preset rotating speeds, and the number of preset rotating speeds in each rotating speed group is the same as the number of the fan speed gears. Multiple preset wind speeds in each rotating speed group are in one-to-one correspondence with the fan speed gears. In each rotating speed group, as a fan speed gear shifts up, a value of a preset wind speed corresponding to the fan speed gear also increases.

All preset rotating speeds corresponding to at least one fan speed gear tend to increase as the resistance of a filter assembly 16*a* corresponding to the rotating speed group in which all the preset rotating speeds are included to the airflow increases.

For example, the types of filter assemblies 16*a* are S1, S2, and S3, respectively, where the resistance of the filter assembly 16*a* of a type S1 to the airflow<the resistance of the filter assembly 16*a* of a type S2 to the airflow<the resistance of the filter assembly 16*a* of a type S3 to the airflow. The multiple rotating speed groups are rotating speed group A, rotating speed group B, and rotating speed group C, respectively. The type S1 of the filter assembly 16*a* corresponds to the rotating speed group A; the type S2 of the filter assembly 16*a* corresponds to the rotating speed group B; and the type S3 of the filter assembly 16*a* corresponds to the rotating speed group C.

Preset rotating speeds included in the rotating speed group A are a1, a2, a3, and a4, where a1>a2>a3>a4. The correspondence between the fan speed gears and the multiple preset rotating speeds included in the rotating speed group A is as follows: "Strong" corresponds to the preset rotating speed a1 in the rotating speed group A, "High" corresponds to the preset rotating speed a2 in the rotating speed group A, "Middle" corresponds to the preset rotating speed a3 in the rotating speed group A, and "Low" corresponds to the preset rotating speed a4 in the rotating speed group A.

Preset rotating speeds included in the rotating speed group B are b1, b2, b3, and b4, where b1> b2>b3>b4. The correspondence between the fan speed gears and the multiple preset rotating speeds included in the rotating speed group B is as follows: "Strong" corresponds to the preset rotating speed b1 in the rotating speed group B, "High" corresponds to the preset rotating speed b2 in the rotating speed group B, "Middle" corresponds to the preset rotating speed b3 in the rotating speed group B, and "Low" corresponds to the preset rotating speed b4 in the rotating speed group B.

Preset rotating speeds included in the rotating speed group C are c1, c2, c3, and c4, where c1> c2>c3>c4. The correspondence between the fan speed gears and the multiple preset rotating speeds included in the rotating speed group C is as follows: "Strong" corresponds to the preset rotating speed c1 in the rotating speed group C, "High" corresponds to the preset rotating speed c2 in the rotating speed group C, "Middle" corresponds to the preset rotating speed c3 in the rotating speed group C, and "Low" corresponds to the preset rotating speed c4 in the rotating speed group C.

The controller 18*a* has at least one of the following configurations: the preset rotating speeds a1, b1 and c1 tend to increase, for example, a1<b1<c1, or a1<b1=c1, or a1=b1<c1; the preset rotating speeds a2, b2 and c2 tend to increase, for example, a2<b2<c2, or a2<b2=c2, or a2=b2<c2; the preset rotating speeds a3, b3 and c3 tend to increase, for example, a3<b3<c3, or a3<b3=c3, or a3=b3<c3; and the preset rotating speeds a4, b4 and c4 tend to increase, for example, a4<b4<c4, or a4<b4=c4, or a4-b4<c4.

In the step of S1*a*, the air supply starting instruction includes information about a set fan speed gear. For example, when a user sends the air supply starting instruction to the controller 18*a* through a remote control or a mobile terminal, a fan speed gear is selected as the set fan speed gear and carried in the air supply starting instruction. This fan speed gear may be a fan speed gear set at the last time when the air supply device 1 is started. For example, if the fan speed gear is switched to "Middle" when the air supply device 1*a* is started last time, the air supply device 1 will be started at "Middle" by default the next time.

In this embodiment, step S3*a* may include a first substep and a second substep.

In the first substep, according to the type of the current filter assembly 16*a*, the controller 18*a* acquires a rotating speed group corresponding to the type of the current filter assembly 16*a*. The method proceeds to the second substep.

In the second substep, according to the set fan speed gear in the air supply starting instruction, the controller 18*a* selects a preset rotating speed corresponding to the set fan speed gear from a rotating speed group corresponding to the type of the current filter assembly 16*a*. The method proceeds to step S4*a*.

For example, when the type of the current filter assembly 16*a* is S1, and the set fan speed gear is "Middle", the controller 18*a* acquires the rotating speed group A corresponding to the type S1 when executing the first substep, and selects the preset rotating speed a3 from the rotating speed group A when executing the second substep, the preset rotating speed a3 being a preset rotating speed to be executed by the fan 15*a* in step S4*a*.

Multiple fan speed gears are provided to enable the user to set the air supply speed of the air supply device 1*a* as needed. Meanwhile, if all preset rotating speeds corresponding to at least one fan speed gear tend to increase as the resistance of a filter assembly 16*a* corresponding to the rotating speed group in which all the preset rotating speeds are included to the airflow increases, the problem of loud noise due to a small resistance of the current filter assembly 16 to the airflow, as well as the problem of low wind outlet speed due to excessive resistance of the current filter assembly 16*a* to the airflow can be avoided under this fan speed gear.

In another embodiment, the controller 18*a* may be provided with multiple fan speed gears. The multiple fan speed gears may be, for example, "Strong", "High", "Middle" and "Low", respectively.

The controller 18*a* is further provided with a basic rotating speed group and multiple variable groups. The basic rotating speed group corresponds to a type of a filter assembly 16*a*, the number of the variable groups is the same as the number of types of remaining filter assemblies 16*a*, and the variable groups are in one-to-one correspondence with the types of the remaining filter assemblies 16*a*.

The basic rotating speed group is provided with multiple preset rotating speeds, the number of the preset rotating speeds in the basic rotating speed group is the same as the number of the fan speed gears, and the multiple preset wind speeds are in one-to-one correspondence with the fan speed gears.

Each variable group is provided with multiple variables, the number of variables in each variable group is the same as the number of the fan speed gears, and the multiple variables are in one-to-one correspondence with the fan speed gears. The variables may be positive or negative.

For example, the types of filter assemblies 16*a* are S1, S2, and S3, respectively, where the resistance of the filter assembly 16*a* of a type S1 to the airflow<the resistance of the filter assembly 16*a* of a type S2 to the airflow<the resistance of the filter assembly 16*a* of a type S3 to the airflow.

The basic rotating speed group corresponds to the type S1 of the filter assembly 16*a*. Preset rotating speeds included in the basic rotating speed group are a1, a2, a3, and a4, respectively, where a1>a2>a3>a4. The correspondence between the multiple preset rotating speeds and the fan speed gears is as follows: "Strong" corresponds to the preset rotating speed a1 in the rotating speed group A, "High" corresponds to the preset rotating speed a2 in the rotating speed group A, "Middle" corresponds to the preset rotating speed a3 in the rotating speed group A, and "Low" corresponds to the preset rotating speed a4 in the rotating speed group A.

The multiple variable groups are variable group B and variable group C, respectively. The type S2 of the filter assembly 16*a* corresponds to the variable group B; and the type S3 of the filter assembly 16*a* corresponds to the variable group C.

The variables included in the variable group B are Δb1, Δb2, Δb3, and Δb4, respectively, where Δb1>Δb2>Δb3>Δb4. The correspondence between the fan speed gears and the multiple variables is as follows: "Strong" corresponds to the variable Δb1 in the rotating speed group B, "High" corresponds to the variable Δb2 in the rotating speed group B, "Middle" corresponds to the variable Δb3 in the rotating speed group B, and "Low" corresponds to the variable Δb4 in the rotating speed group B.

The variables included in the variable group C are Δc1, Δc2, Δc3, and Δc4, respectively, where Δc1> Δc2>Δc3>Δc4. The correspondence between the fan speed gears and the multiple variables is as follows: "Strong" corresponds to the variable Δc1 in the rotating speed group C, "High" corresponds to the variable Δc2 in the rotating speed group B, "Middle" corresponds to the variable Δc3 in the rotating speed group C, and "Low" corresponds to the variable Δc4 in the rotating speed group C.

In the step of S1*a*, the air supply starting instruction includes information about a set fan speed. For example, when a user sends the air supply starting instruction to the controller 18*a* through a remote control or a mobile terminal, a fan speed gear is selected as a set fan speed gear and carried in the air supply starting instruction. This fan speed gear may be a fan speed gear set at the last time when the air supply device 1*a* is started. For example, if the fan speed gear is switched to "Middle" when the air supply device 1*a* is started last time, the air supply device 1*a* will be started at "Middle" by default the next time.

In this embodiment, step S3*a* may include first to sixth substeps.

In a first substep, the controller 18*a* determines whether the type of the current filter assembly 16*a* is a type of a filter assembly 16*a* corresponding to the basic rotating speed group, if yes, the method proceeds to a second substep, otherwise, the method proceeds to a third substep.

In the second substep, according to the set fan speed gear in the air supply starting instruction, the controller 18*a* acquires a preset rotating speed corresponding to the set fan speed gear from the basic rotating speed group, and takes the preset rotating speed as a preset rotating speed to be executed by the fan 15. The method proceeds to step S4*a*.

In the third substep, according to the set fan speed gear, the controller 18*a* acquires a preset rotating speed corresponding to the set fan speed gear from the basic rotating speed group. The method proceeds to a fourth substep.

In the fourth substep, according to a type of a current filter assembly 16*a*, the controller 18*a* acquires a variable group corresponding to the type, and the method proceeds to a fifth substep.

In the fifth substep, the controller 18*a* acquires, according to the set fan speed gear in the air supply starting instruction, a variable corresponding to the set fan speed gear from the variable group.

In a sixth substep, the variable is added to the preset rotating speed for acquiring a preset rotating speed to be executed by the fan 15*a*. The method proceeds to step S4*a*.

The preset rotating speed to be executed by the fan 15*a* is a rotating speed at which the controller 18*a* drives the fan 15*a* to rotate in step S4*a*.

In this way, if the type of the current filter assembly 16*a* is the type corresponding to the basic rotating speed group, the preset rotating speed corresponding to the set fan speed gear in the basic rotating speed group is directly used as the preset rotating speed to be executed by the fan 15*a* in step S4*a*. If the type of the current filter assembly 16*a* is the type corresponding to a variable group, a variable corresponding to the set fan speed gear in the variable group and a preset rotating speed corresponding to the set fan speed gear in the basic rotating speed group are acquired, and then the variable is added to the preset rotating speed for acquiring a preset rotating speed to be executed by the fan 15 in step S4*a*.

For example, when the type of the current filter assembly 16*a* is S1, and the set fan speed gear is "Middle", the controller 18*a* first determines whether the type S1 of the filter assembly 16*a* is the type of the filter assembly 16*a* corresponding to the basic rotating speed group. After determining that the type S1 of current filter assembly 16*a* is the type corresponding to the basic rotating speed group, the controller 18*a* acquires the preset rotating speed a3 corresponding to the "Middle" from the basic rotating speed group, and takes the preset rotating speed a3 as a preset rotating speed to be executed by the fan 15*a*.

When the type of the current filter assembly 16*a* is S2, and the set fan speed gear is "High", the controller 18*a* first determines whether the type S2 of the current filter assembly 16*a* is the type corresponding to the basic rotating speed group. After determining that the type S2 of the filter assembly 16*a* is not the type of the filter assembly 16*a* corresponding to the basic rotating speed group, the controller 18*a* first acquires the preset rotating speed a2 corresponding to the "High" from the basic rotating speed group, then acquires the variable Δb2 corresponding to the "High" from the variable group B corresponding to the type S2 of the filter assembly 16*a*, then calculates the sum of the preset rotating speed a2 and the variable Δb2, and finally takes a calculation result as a preset rotating speed to be executed by the fan 15*a*.

All preset rotating speeds corresponding to at least one fan speed gear tend to increase as the resistance of the filter assembly 16*a* of the type corresponding to the rotating speed group in which all the preset rotating speeds are included to the airflow increases. In this embodiment, there is at least one of the following configurations: the preset rotating speed corresponding to "Strong" tends to increase, a1< (a1+Δb1)< (a1+Δc1), or a1< (a1+Δb1)=(a1+Δc1), or a1=(a1+Δb1)< (a1+Δc1); the preset rotating speed corresponding to "High" tends to increase, for example, a2< (a2+Δb2)< (a2+Δc2), or a2< (a2+Δb2)=(a2+Δc2), or a2=(a2+Δb2)< (a2+Δc2); the preset rotating speed corresponding to "Middle" tends to increase, for example, a3< (a3+Δb3)< (a3+Δc3), or a3< (a3+Δb3)=(a3+Δc3); and the preset rotating speed corresponding to "Low" tends to increase, for example, a4<b4<c4, or a4<b4=c4, or a4-b4<c4.

Multiple fan speed gears are provided to enable the user to set the air supply speed of the air supply device 1*a* as needed. Meanwhile, if all preset rotating speeds corresponding to at least one fan speed gear tend to increase as the resistance of the filter assembly 16*a* corresponding to the rotating speed group in which the preset rotating speeds are included to the airflow increases, the problem of loud noise due to a small resistance of the current filter assembly 16 to the airflow, as well as the problem of low wind outlet speed due to excessive resistance of the current filter assembly 16*a* to the airflow can be avoided under this fan speed.

It should be noted that the above-mentioned control method for an air supply device 1*a* may be applied to the air supply device 1*a* of this embodiment, and any example for illustration of the above-mentioned control method may be applied to illustrate the air supply device 1*a* of this embodiment, which will not be repeated here.

The above-mentioned embodiments are only preferred embodiments of the present disclosure, and are not intended to limit the scope of the present disclosure. Any equivalent structural transformation made using the contents of the description and drawings of the present disclosure under the concept of the present disclosure, or direct/indirect application in other related technical fields are all included in the scope of the present disclosure.

What is claimed is:

1. A control method for an air supply device, wherein the air supply device is capable of being mounted with different types of filter assemblies, each filter assembly comprises a filter screen, and types and/or numbers of filter screens in the different types of filter assemblies are different, the control method comprising:

receiving an air supply starting instruction, and acquiring a type of a current filter assembly;

acquiring a preset rotating speed corresponding to the type of the current filter assembly; and driving a fan of the air supply device to rotate at the preset rotating speed, wherein one of multiple types of the filter assemblies corresponds to a basic rotating speed group, and all the remaining types are in one-to-one correspondence with multiple variable groups;

the basic rotating speed group comprises multiple preset rotating speeds corresponding to multiple fan speed gears;

the variable group comprises multiple variables in one-to-one correspondence with the multiple fan speed gears;

the air supply starting instruction comprises information about a set fan speed gear;

the acquiring the preset rotating speed corresponding to the type of the current filter assembly comprises:

in response to the type of the current filter assembly being the type corresponding to the basic rotating speed group, selecting a preset rotating speed corresponding to the set fan speed gear from the basic rotating speed group as a preset rotating speed to be executed by the fan; and in response to the type of the current filter assembly not being the type corresponding to the basic rotating speed group, selecting a variable corresponding to the set fan speed gear from a variable group corresponding to the type of the filter assembly, selecting a preset rotating speed corresponding to the set fan speed gear from the basic rotating speed group, and adding the preset rotating speed to the variable for acquiring a preset rotating speed to be executed by the fan, and under at least one fan speed gear, the preset rotating speed to be executed by the fan tends to increase with an increasing resistance of the type of the current filter assembly to an airflow.

2. The control method of claim 1, wherein under a same fan speed gear, the higher the preset rotating speed is, the greater the resistance of the filter assembly of the type corresponding to the preset rotating speed to the airflow is.

3. The control method of claim 2, wherein:

multiple fan speed gears are provided, and preset rotating speeds corresponding to a same type of filter assembly are different under different fan speed gears;

the air supply starting instruction comprises information about a set fan speed gear; and the acquiring a preset rotating speed corresponding to the type of the current filter assembly comprises acquiring a preset rotating speed corresponding to the type of the current filter assembly under the set fan speed gear.

4. The control method of claim 1, wherein:

the air supply device further comprises a detection assembly, and the type of the current filter assembly is detected by the detection assembly.

5. The control method of claim 4, wherein the detection assembly comprises multiple position switches, and the multiple position switches are in one-to-one correspondence with the filter screens mounted in the air supply device, in response to any one of the filter screens being mounted in place, a corresponding position switch is triggered; and multiple types of filter assemblies are in one-to-one correspondence with multiple combinations of triggered position switches;

the control method further comprising:

acquiring, according to a combination of triggered position switches, a type of a filter assembly corresponding to the combination, and saving the type as the type of the current filter assembly.

6. An air supply device comprising:

a cabinet, internally provided with a runner in which different types of filter assemblies are mountable;

a filter assembly, comprising a filter screen disposed in the runner;

a fan, disposed in the runner; and a controller, electrically connected to the fan and configured to control the air supply device according to the control method of claim 1.

7. The air supply device of claim 6, wherein:

the air supply device further comprises a detection assembly;

the detection assembly comprises multiple position switches which are all electrically connected to the controller, and the multiple position switches are in one-to-one correspondence with multiple filter screens mounted in the air supply device;

the position switch is configured to be triggered in response to a corresponding filter screen being mounted in place on the air supply device; and the controller is configured to acquire a type of a filter assembly corresponding to a combination of triggered position switches, and save the type as a type of a current filter assembly.

8. The air supply device of claim 6, wherein the air supply device comprises a fresh air machine, an air conditioner or an air purifier.

9. A control method for an air supply device, wherein the air supply device is capable of being mounted with different types of filter assemblies, each filter assembly comprises a filter screen, and types and/or numbers of filter screens in the different types of filter assemblies are different, the control method comprising:

driving a fan of the air supply device to rotate at a test rotating speed, and measuring a power parameter of the fan;

taking a type of a filter assembly which is preset and corresponds to the power parameter as a type of a current filter assembly;

acquiring a preset rotating speed corresponding to the type of the current filter assembly; and driving the fan of the air supply device to rotate at the preset rotating speed, wherein one of multiple types of the filter assemblies corresponds to a basic rotating speed group, and all the remaining types are in one-to-one correspondence with multiple variable groups;

the basic rotating speed group comprises multiple preset rotating speeds in one-to-one correspondence with multiple fan speed gears;

the variable group comprises multiple variables in one-to-one correspondence with the multiple fan speed gears;

acquiring a preset rotating speed corresponding to the type of the current filter assembly comprises:

in response to the type of the current filter assembly being the type corresponding to the basic rotating speed group, selecting a preset rotating speed corresponding to a set fan speed gear from the basic rotating speed group as a preset rotating speed to be executed by the fan; and in response to the type of the current filter assembly not being the type corresponding to the basic rotating speed group, selecting a variable corresponding to the set fan speed gear from a variable group corresponding to the type of the filter assembly, selecting a preset rotating speed corresponding to the set fan speed gear from the basic rotating speed group, and adding the preset rotating speed to the variable for acquiring a preset rotating speed to be executed by the fan, and under at least one fan speed gear, the preset rotating speed to be executed by the fan tends to increase with an increasing resistance of the type of the current filter assembly to an airflow.

10. The control method of claim 9, wherein the power parameter comprises a current value of the fan or a power value of the fan.

11. The control method of claim 10, wherein multiple value intervals of the power parameter with non-overlapping ranges are preset, and each of the value intervals corresponds to a type of a filter assembly;

taking a type corresponding to the power parameter as a type of a current filter assembly comprises:

determining a value interval within which the power parameter falls, acquiring a type of a filter assembly corresponding to the value interval, and taking the acquired type as a type of a current filter assembly.

12. The control method of claim 11, wherein at the test rotating speed of the fan, the greater the resistance of the filter assembly to an airflow is, the greater the value in the value interval corresponding to the type of the filter assembly is.

13. The control method of claim 9, wherein under a same fan speed gear, the higher the preset rotating speed is, the greater the resistance of the filter assembly of the type corresponding to the preset rotating speed to the airflow is.

14. The control method of claim 13, wherein multiple fan speed gears are provided, and preset rotating speeds corresponding to a same type of filter assembly are different under different fan speed gears;

acquiring a preset rotating speed corresponding to the type of the current filter assembly comprises: acquiring a preset rotating speed corresponding to the type of the current filter assembly under the set fan speed gear.

15. An air supply device comprising:

a cabinet, internally provided with a runner in which different types of filter assemblies are mounted;

a filter assembly, comprising a filter screen disposed in the runner;

a fan, disposed in the runner; and a detection device, configured to measure a power parameter of the fan; and a controller, electrically connected to the fan and the detection device and configured to control the air supply device according to the control method of claim 9.

16. The air supply device of claim 15, wherein the detection device comprises a current measurement device or a power measurement device.

17. A control method for an air supply device, wherein the air supply device is capable of being mounted with different types of filter assemblies, each filter assembly comprises a filter screen, and types and/or numbers of filter screens in the different types of filter assemblies are different, the control method comprising:

driving a fan of the air supply device to rotate at a test rotating speed, and measuring a power parameter of the fan;

taking a type of a filter assembly which is preset and corresponds to the power parameter as a type of a current filter assembly;

acquiring a preset rotating speed corresponding to the type of the current filter assembly; and driving the fan of the air supply device to rotate at the preset rotating speed, wherein multiple value intervals of the power parameter with non-overlapping ranges are preset, and each of the value intervals corresponds to a type of a filter assembly;

taking a type corresponding to the power parameter as a type of a current filter assembly comprises:

determining a value interval within which the power parameter falls, acquiring a type of a filter assembly corresponding to the value interval, and taking the acquired type as a type of a current filter assembly.

* * * * *